US006578953B2

(12) United States Patent
Kitahara et al.

(10) Patent No.: US 6,578,953 B2
(45) Date of Patent: Jun. 17, 2003

(54) INKJET RECORDING HEAD, PIEZOELECTRIC VIBRATION ELEMENT UNIT USED FOR THE RECORDING HEAD, AND METHOD OF MANUFACTURING THE PIEZOELECTRIC VIBRATION ELEMENT UNIT

(75) Inventors: Tsuyoshi Kitahara, Nagano (JP); Hiroshi Arai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/726,036

(22) Filed: Nov. 30, 2000

(65) Prior Publication Data

US 2001/0038404 A1 Nov. 8, 2001

Related U.S. Application Data

(63) Continuation-in-part of application No. 09/537,680, filed on Mar. 29, 2000.

(30) Foreign Application Priority Data

Mar. 29, 1999 (JP) ..... P.11-85788
Feb. 4, 2000 (JP) ..... P.2000-28025
Mar. 17, 2000 (JP) ..... P.2000-76269

(51) Int. Cl.[7] ..... B41J 2/045
(52) U.S. Cl. ..... 347/68; 347/70
(58) Field of Search ..... 347/70, 68, 50

(56) References Cited

U.S. PATENT DOCUMENTS 5,517,225 A 5/1996 Miyazawa et al. ..... 347/71
5,933,168 A * 8/1999 Sakai ..... 347/70
5,945,773 A 8/1999 Nagashima ..... 310/328
5,992,976 A * 11/1999 Kimura et al. ..... 347/50
6,264,310 B1 * 7/2001 Toru et al. ..... 347/70

FOREIGN PATENT DOCUMENTS

| | | | |
|---|---|---|---|
| DE | 197 45 980 | 10/1998 | ..... B41J/2/145 |
| EP | 550030 | 7/1993 | ..... B41J/2/045 |
| EP | 443628 | 7/1996 | ..... B41J/2/045 |
| EP | 761447 | 3/1997 | |
| EP | 787589 | 8/1997 | |
| EP | 860279 | 8/1998 | |
| EP | 861725 | 9/1998 | |
| JP | 6-8423 | 1/1994 | |
| JP | 7-186379 | 7/1995 | |
| JP | 8-1934 | 1/1996 | |
| JP | WO96/00151 | 1/1996 | |
| JP | 8-118623 | 5/1996 | |
| JP | 10-181014 | 7/1998 | |

* cited by examiner

*Primary Examiner*—Thinh Nguyen
(74) *Attorney, Agent, or Firm*—Sughrue Mion, PLLC

(57) ABSTRACT

A dummy piezoelectric element (7) is disposed at least at one of the ends of an array of piezoelectric vibration elements. A region not including internal electrodes is provided in the vicinity of the outer side surface of the dummy piezoelectric vibration element 7 to be formed. When the outer side surface of the dummy piezoelectric element 7 is cut, a shift of a cutting line from a correct cutting line, which is due to high hardness of the internal electrodes, is minimized.

42 Claims, 15 Drawing Sheets

INKJET RECORDING HEAD, PIEZOELECTRIC VIBRATION ELEMENT UNIT USED FOR THE RECORDING HEAD, AND METHOD OF MANUFACTURING THE PIEZOELECTRIC VIBRATION ELEMENT UNIT

This is a Continuation-in-Part of application Ser. No. 09/537,680 filed Mar. 29, 2000.

BACKGROUND OF THE INVENTION

The present invention relates to an inkjet recording head which uses, as a pressure generating source, piezoelectric vibration elements of the longitudinal vibration type, which are each constructed such that a plurality of internal electrodes are alternately layered in a state that piezoelectric material is interposed therebetween.

The inkjet recording head, which uses the piezoelectric vibration elements each vibrating in the longitudinal vibration mode, includes a plurality of linear arrays each consisting of pressure generating chambers, each chamber communicating with a nozzle orifice and a part of each chamber being sealingly closed with an elastically deformable plate member. Each pressure generating chamber is expanded and contracted by its associated piezoelectric vibration element which axially deflects in accordance with a drive signal applied thereto.

The piezoelectric vibration elements are constructed as a unit form as shown in FIG. 15. That is, a piezoelectric vibrating plate, which is wide enough to cover a plurality of piezoelectric vibration elements, is fastened to a fixing plate 60, and is cut into a plurality of piezoelectric vibration elements 61 with a wire saw or the like to be arranged at a constant pitch.

Dummy piezoelectric vibration elements 62 and 63, which are not associated with the ink drop ejecting operation, are provided at both ends of a linear array of piezoelectric vibration elements in order to improve the workability in positioning the piezoelectric vibration elements in the stage of assembling. In assembling the piezoelectric vibration elements, the outer side surfaces 62' and 63' of the dummy piezoelectric vibration elements 62 and 63 are used as a reference in setting the piezoelectric vibration element unit to a case, whereby the piezoelectric vibration elements 61 are positioned with respect to the fluid channel unit within a predetermined tolerance.

The piezoelectric vibrating plate is formed such that internal electrode material layers including metal and piezoelectric material layers are layered, and the resultant layered structure is sintered. The cutting of the thus formed piezoelectric vibrating plate with a wire saw into a plurality of piezoelectric vibration elements will minutely shift the actual cutting lines from the correct cutting lines since the internal electrodes are hard. The shift of the cutting lines greatly affects an accuracy of the relative positioning of the piezoelectric vibration element unit when the distal ends of the piezoelectric vibration elements are reduced in area for the purpose of increasing a print density.

SUMMARY OF THE INVENTION

Accordingly, an object of the present invention is to provide an inkjet recording head in which piezoelectric vibration elements are positioned at predetermined positions with high accuracy.

Another object of the invention is to provide a piezoelectric vibration element unit which is configured with high accuracy.

A third object of the invention is to provide a method of manufacturing the piezoelectric vibration element unit.

According to the present invention, a dummy piezoelectric element is disposed at least at one of the ends of a linear array of piezoelectric vibration elements. A region not including an internal electrode is provided in the vicinity of the outer side surface of said dummy piezoelectric vibration element. When the outer side surface of the dummy piezoelectric element is formed by cutting, a shift of a cutting line due to high hardness of the internal electrode is minimized. That is, the outer side surface of the dummy piezoelectric element can be defined with high accuracy. The piezoelectric vibration element unit can be positioned with high accuracy using the dummy piezoelectric element as a positioning reference.

An inkjet recording head according to the present invention preferably includes a piezoelectric vibration element unit in which a plurality of piezoelectric vibration elements, each of which is axially expandable, and is made up of piezoelectric material layers and internal electrodes which are alternately layered, are linearly arrayed on a substrate. The volumes of pressure generating chambers are increased and decreased by said piezoelectric vibration elements associated respectively with said pressure generating chambers. A dummy piezoelectric vibration element is provided at least one end of a linear array of piezoelectric vibration elements, and a region not including the internal electrodes is provided in the vicinity of the outer side surface of said dummy piezoelectric vibration element.

Thus, in the inkjet recording head of the preferable construction, the internal electrodes are not contained in a region in the vicinity of the outer side surface of said dummy piezoelectric vibration element. Therefore, the cutting of the piezoelectric vibrating plate along the outer side surface of the dummy piezoelectric vibration element does not cause a shift of an actual cutting line from the correct cutting line due to the high hardness of the internal electrodes. Therefore, the piezoelectric vibrating plate can be highly accurately cut.

The present disclosure relates to the subject matter contained in Japanese patent application Nos. Hei. 11-85788 (filed on Mar. 29, 1999) and 2000-76269 (filed on Mar. 17, 2000), which are expressly incorporated herein by reference in their entireties.

BRIEF DESCRIPTION OF THE DRAWINGS

FIGS. 5(I) to 5(III) are perspective views showing the first half of a method of manufacturing a piezoelectric vibrating plate in a method of manufacturing the piezoelectric vibrating plate.

FIGS. 7(I) to 7(III) are perspective views showing a process for manufacturing piezoelectric vibration elements by use of a piezoelectric vibrating plate in the method of manufacturing the piezoelectric vibration element unit.

FIGS. 13(I) to 13(III) show perspective views showing a process of manufacturing a piezoelectric vibration element unit which is another embodiment of the invention.

DESCRIPTION OF THE PREFERRED EMBODIMENT

The present invention will be described in detail with reference to the accompanying drawings.

Figure 1:
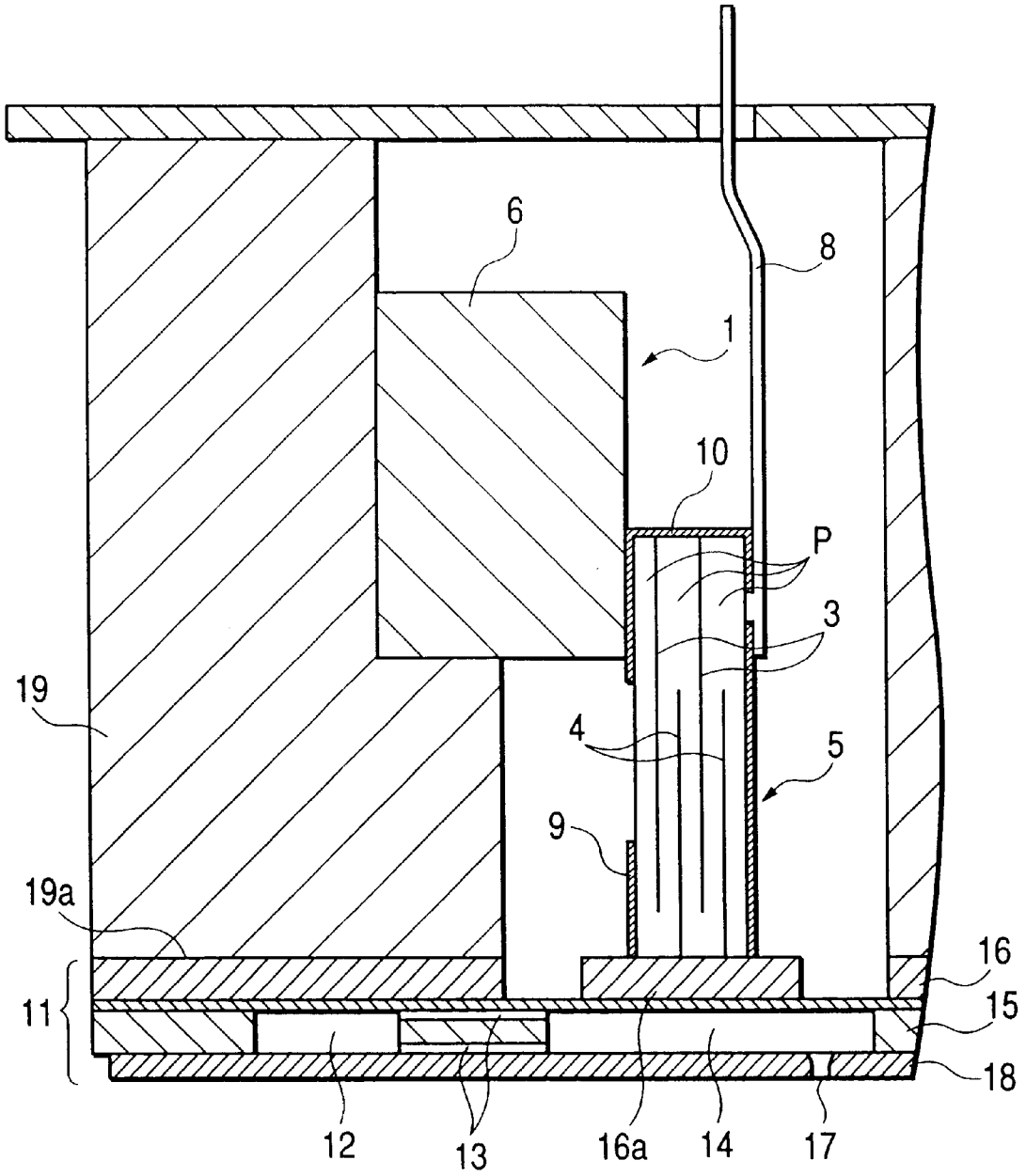
FIG. 1 is a cross sectional view mainly showing a driving piezoelectric vibration element in an inkjet recording head which is an embodiment of the present invention.
Figure 4:
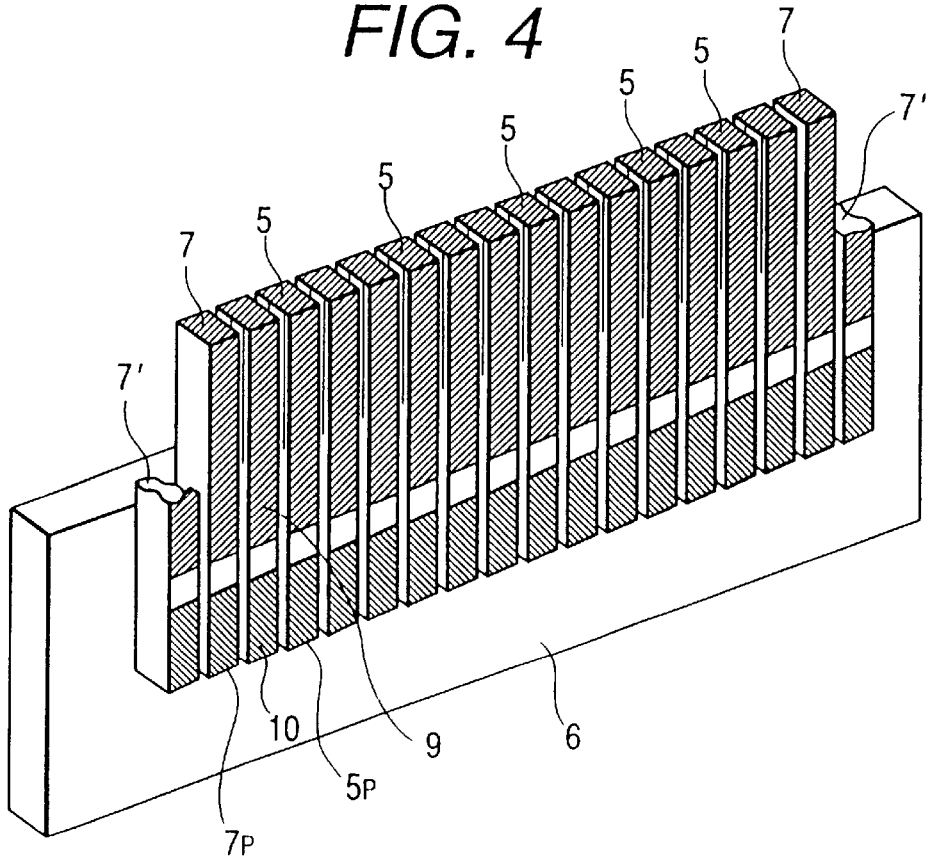
FIG. 4 is a perspective view showing an embodiment of a piezoelectric vibration element unit according to the present invention.

FIG. 1 shows an embodiment of the present invention. In a piezoelectric vibration element unit 1 which is one of the featured components of the present invention, piezoelectric vibration elements 5, as shown in FIG. 4, are disposed at fixed pitches along a fixing plate 6. In each piezoelectric vibration element 5, internal electrodes 3 and 4 having different poles are arranged parallel to one another, and extend in the axial or longitudinal direction of the element 5. Those internal electrodes 3 and 4 are exposed to outside at respective ends, that is, in this embodiment the internal electrodes 3 are exposed at the proximal ends of the piezoelectric vibration elements 5, whereas the other internal electrodes 4 are exposed at the distal ends of the piezoelectric elements 5. Those internal electrodes 3 and 4 are layered one on another in a state that piezoelectric material P is interlayered therebetween in a vibration region of the element 5. That is, each of the piezoelectric vibration element 5 has a layered construction in which electrically conductive layers and piezoelectric material layers are stacked one on another alternately. Dummy piezoelectric elements 7 are located at both ends of an array of the piezoelectric vibration elements 5. The remains 7' of the dummy piezoelectric elements 7, which are produced as a consequence of the formation of the dummy piezoelectric elements 7 are present on the outer side of the dummy piezoelectric elements 7.

Figure 2:
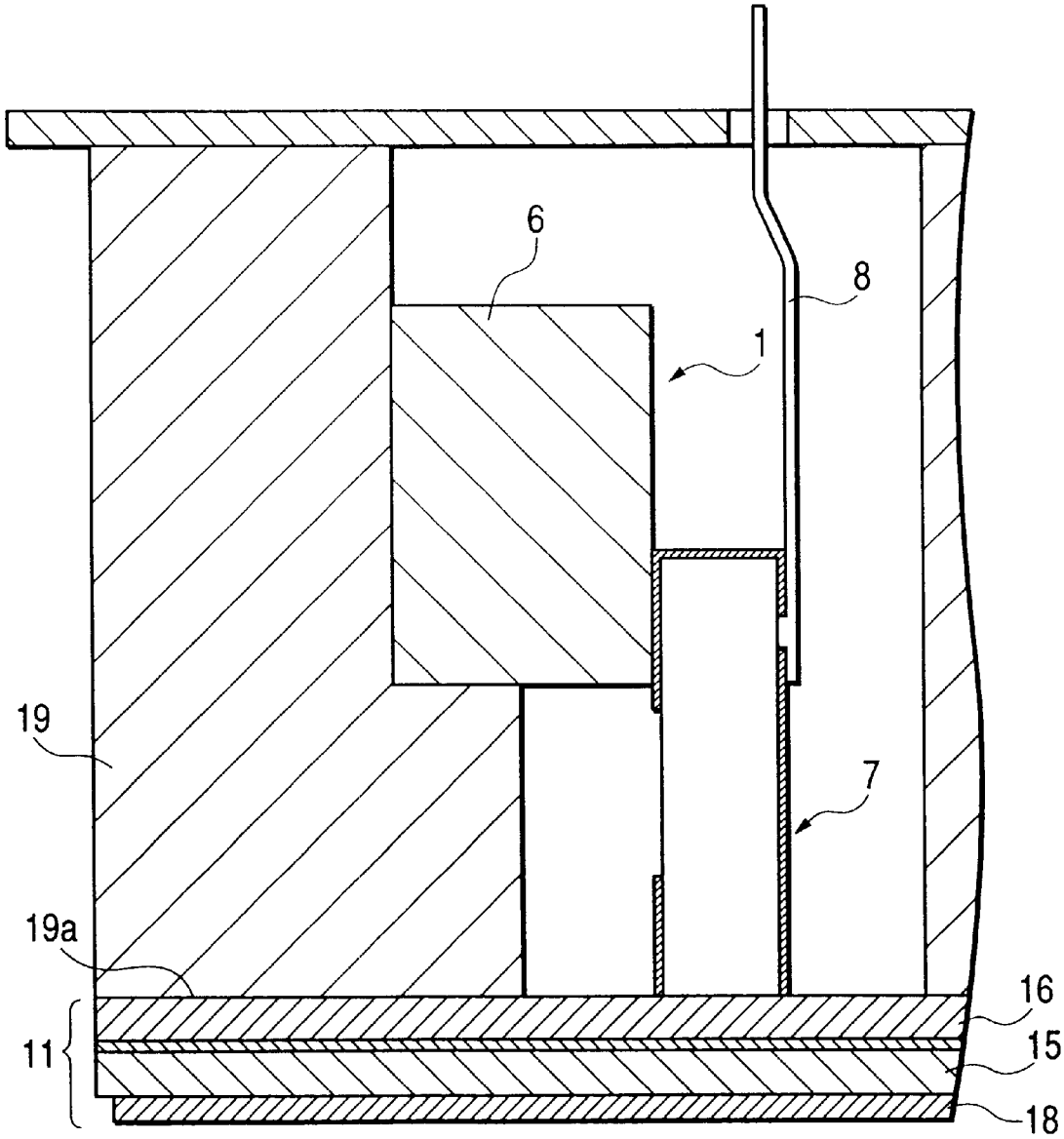
FIG. 2 is a cross sectional view mainly showing a dummy piezoelectric vibration element in the inkjet recording head.

As shown in FIG. 2, the outer side surfaces of the dummy piezoelectric elements 7 are formed of only piezoelectric material P, not including electrodes.

External electrodes 9 and 10, which form connection parts to a flexible cable 8 for supplying a drive signal are formed, by sputtering or vapor deposition, over regions ranging from the distal and proximal end faces of each piezoelectric vibration element 5 where the internal electrodes 3 and 4 are exposed, to a surface of the fixing plate (6) side. In this embodiment, the internal electrodes 3 are common (grounded) electrodes, and the internal electrodes 4 are segment electrodes.

A fluid channel forming unit 11 is formed by liquid-tightly laminating a fluid channel forming substrate 15 defining a reservoir 12, ink supplying ports 13 and pressure generating chambers 14, an elastic plate 16 which is brought into contact with the distal end of piezoelectric vibration elements 5 to increase and reduce the volumes of the associated pressure generating chambers 14, and a nozzle plate 18 which sealingly closes the opposite surface of the fluid channel forming substrate 15 and has nozzle orifices 17 for ejecting ink, which is supplied from the pressure generating chambers 14, in the form of ink drops.

The fluid channel forming unit 11 is fixed to an opened surface 19*a* of a head holder 19. The distal ends of the piezoelectric vibration elements 5 are coated with adhesive and brought into contact with islands 16*a* of the elastic plate 16. The fixing plate 6 is fixed to the head holder 19 by adhesive. In this manner, the inkjet recording head is formed.

Figure 3:
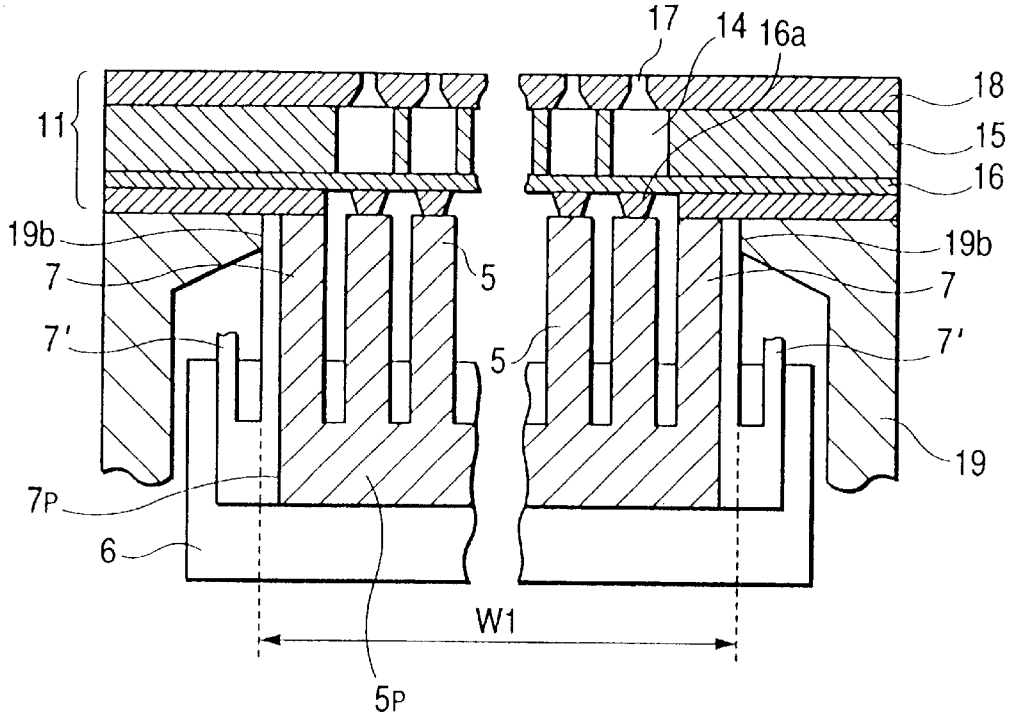
FIG. 3 is a view showing a structure of the inkjet recording head when a piezoelectric vibration element unit is assembled into a head holder.

As shown in FIG. 3, the outer side surfaces of the dummy piezoelectric elements 7, which are located at both ends of the array of the piezoelectric vibration elements 5, are brought into contact with the inner surfaces 19*b* of a piezoelectric-vibration-elements accommodating chamber of the head holder 19, whereby the piezoelectric vibration element unit 1 is positioned in place with respect to the head holder 19 and thus the fluid channel forming unit 11. That is, in this embodiment, each dummy piezoelectric element 7 is used as a positioning member, and the outer side surface of each dummy piezoelectric element 7 is used as a reference surface for positioning the piezoelectric vibration element unit 1 with respect to the head holder 19.

In the inkjet recording head thus constructed, in operation, a drive signal is applied to a piezoelectric vibration element 5, which is associated with a pressure generating chamber 14 communicating with a nozzle orifice 17 through which ink is to be ejected. In response to the drive signal, the piezoelectric vibration element 5 is shrunk and expanded to increase and decrease the volume of the pressure generating chamber 14. As a result, ink flows into the pressure generating chamber 14 through the ink supplying ports 13, and the ink within the pressure generating chamber 14 is pressurized and forcibly discharged in the form of an ink drop through the nozzle orifice 17.

Figure 5:
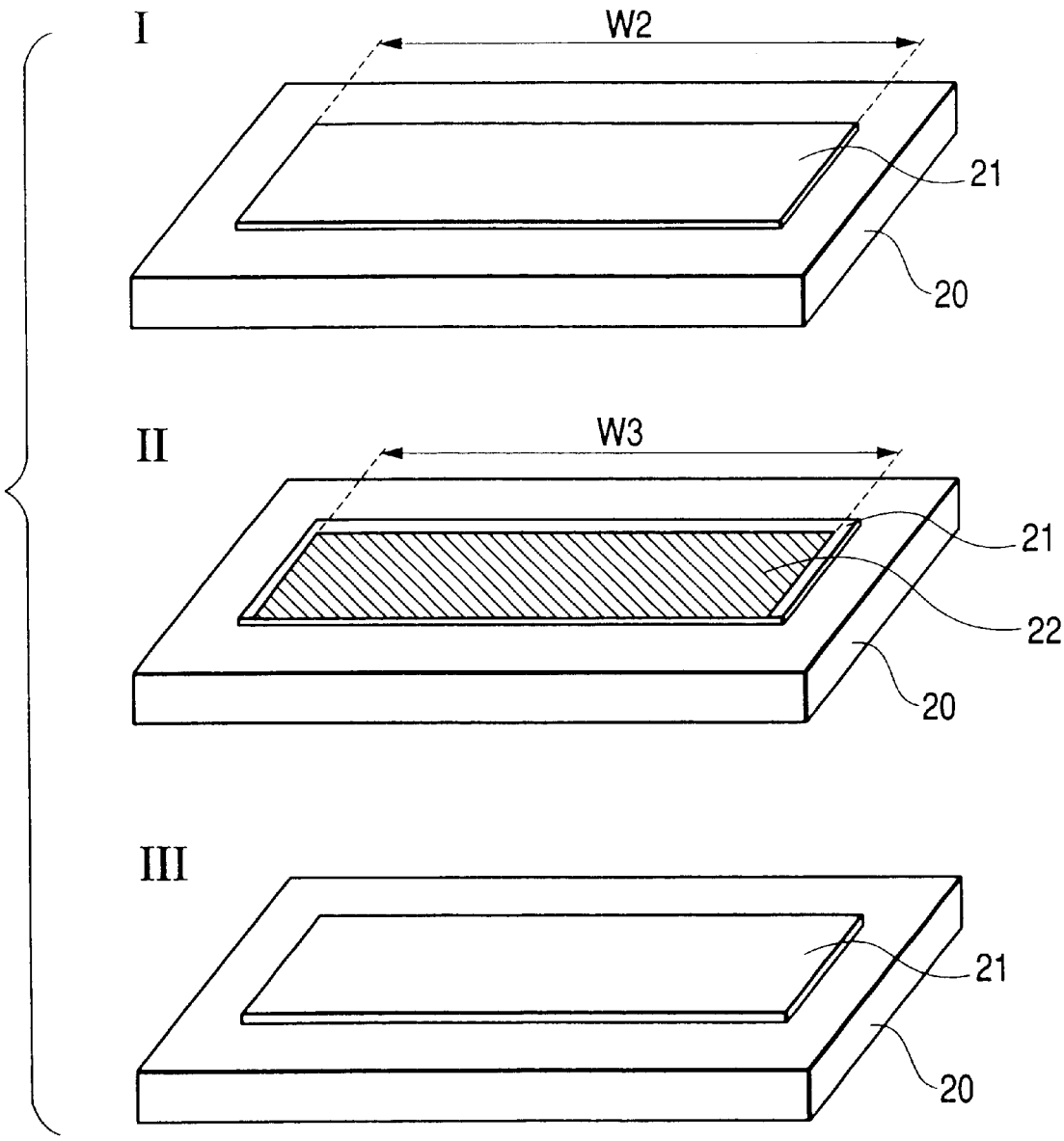
Figure 6:
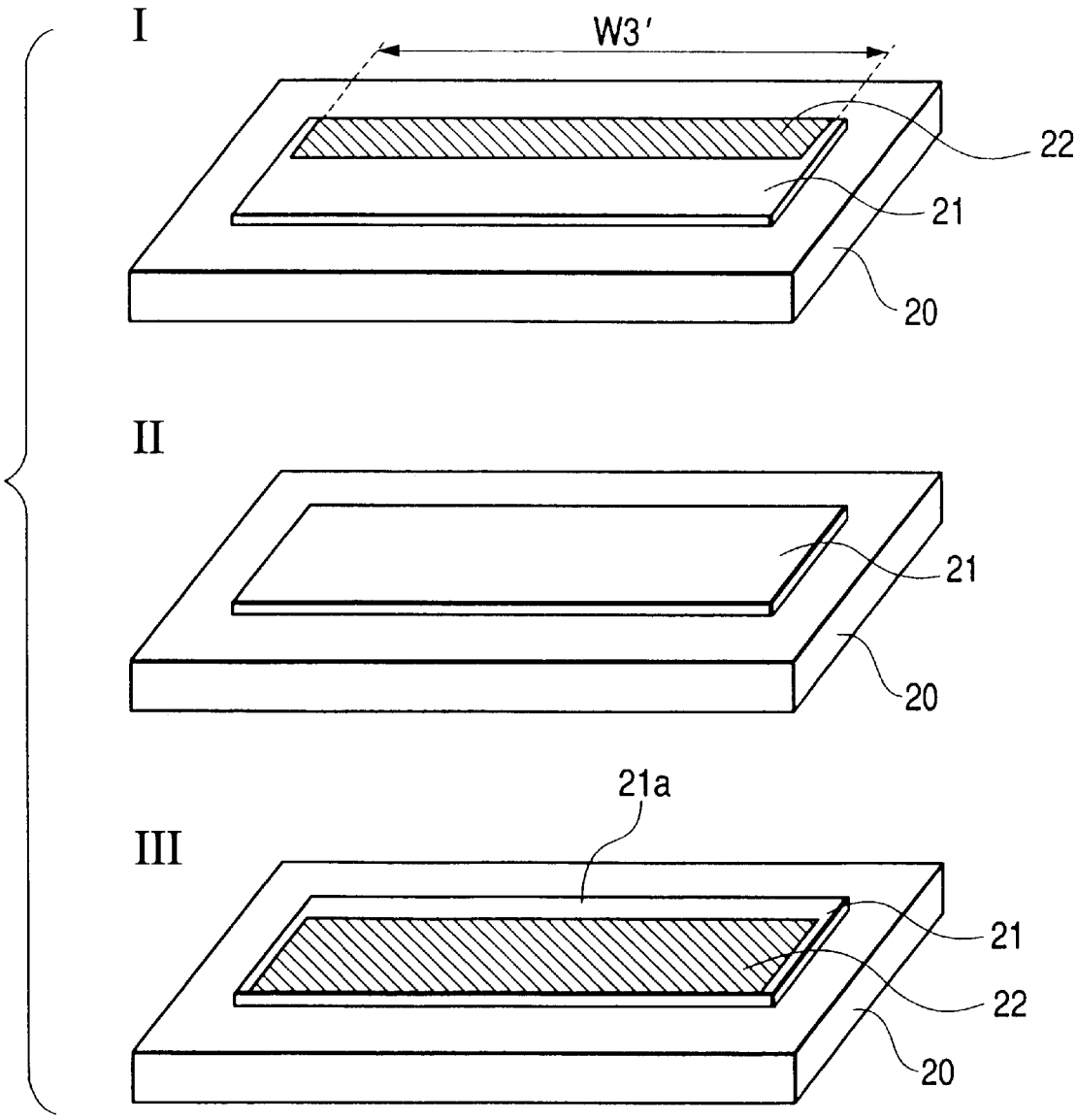
FIGS. 6(I to 6(III) are perspective views showing the second half of the method of manufacturing a piezoelectric vibrating plate.
Figure 7:
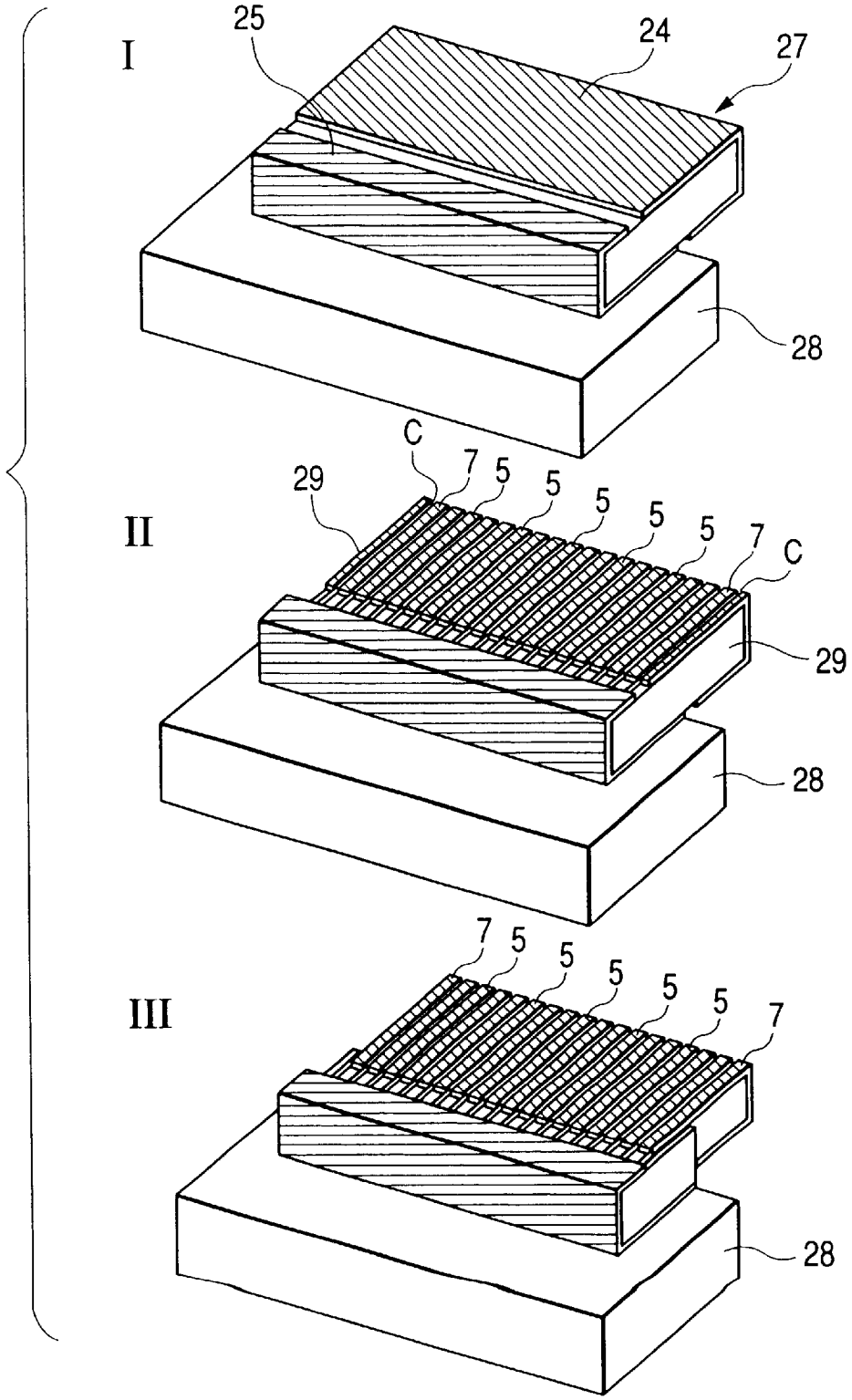

FIGS. 5 through 7 exemplarily show a method of manufacturing piezoelectric vibration elements 5 thus structured. As shown, a green sheet 21 made of piezoelectric material is placed on a base plate 20 having a flat surface (FIG. 5(I)). The green sheet 21 is preliminarily prepared so as to have the width W2 which is somewhat longer than the width W1 (see FIG. 3) of a portion of the piezoelectric vibration element unit 1 where the piezoelectric vibration elements 5 and dummy piezoelectric elements 7 are formed (the width W1 being defined between the outer side surface of the one dummy piezoelectric element 7 and the outer side surface of the other dummy piezoelectric element 7), and to have a thickness equal to the piezoelectric material layer.

A conductive layer 22 which serves as the internal electrode 3 which is one of the coupled internal electrodes is formed on a surface of the green sheet 21 by use of a mask with a pattern having such a width W3 that the conductive layer 22 is located on the inner side with respect to the outer side surfaces of the dummy piezoelectric elements 7 but on the outer side with respect to the piezoelectric vibration elements 5 adjacent to the dummy piezoelectric elements 7 (FIG. 5(II)). Then, another green sheet 21, which is made of piezoelectric material and has the same size as of the former green sheet already stated, is layered on the conductive layer thus formed (FIG. 5(III)).

A conductive layer 23 which serves as the other internal electrode 4 is formed on a surface of the green sheet 21 by use of a mask with a pattern having such a width W3' that the conductive layer is located on the inner side with respect to the outer side surfaces of the dummy piezoelectric elements 7 but on the outer side with respect to the piezoelectric vibration elements 5 adjacent to the piezoelectric elements 7 (FIG. 6(I)). Then, another green sheet 21, which is made of piezoelectric material and has the same size as of the green sheet already stated, is layered on the conductive layer 23 thus formed (FIG. 6(II)).

A sequence of manufacturing steps mentioned above is repeated to form the required number of layers (FIG. 6(III). The green sheets are dried, and then the resultant structure is sintered. External electrodes 24 and 25, which serve as electrodes used for the connection to a flexible cable 8, are formed on a surface of the structure by sputtering or vapor deposition process. A given dielectric polarization process is carried out by applying voltage to those electrodes 24 and 25. In this way, a piezoelectric vibrating plate 27 is manufactured. A non-vibration region, i.e. an inactive region, of the piezoelectric vibrating plate 27 is positioned to a fixing plate 28 and secured thereto by adhesive (FIG. 7(I)).

Figure 8:
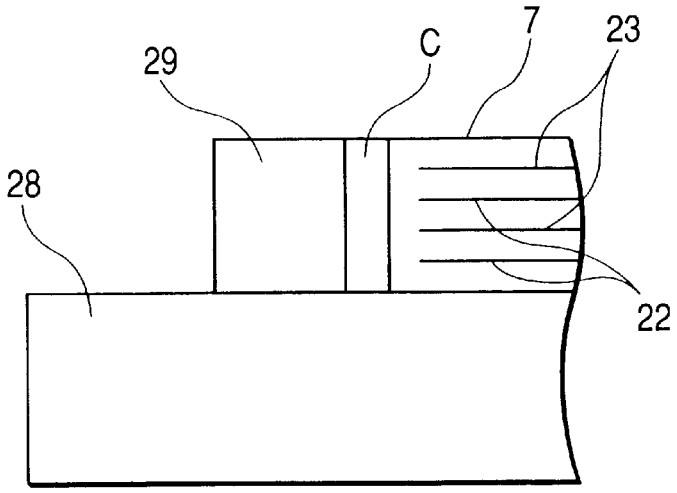
FIG. 8 is a cross sectional view showing a cutting region of a dummy piezoelectric element.

The piezoelectric vibrating plate is cut into a teeth shape or a comb shape with a cutting tool, for example, a wire saw, such that the cutting lines on both ends of the piezoelectric vibrating plate (i.e., the outermost cutting lines C in this embodiment) are located outside the conductive layers 22 and 23, and the width of the dummy piezoelectric elements 7 and the width of the piezoelectric vibration elements 5 are exactly secured. In the cutting process, the outermost cutting lines C are positioned in the regions which are made of only piezoelectric material, not including the conductive layers 22 and 23 (FIG. 8). Therefore, the cutting operation is smoothly performed while being free from a slip caused by the presence of the metallic material. Thus, the piezoelectric vibrating plate 27 can be cut to have cut surfaces coincident in position with the intended cutting lines.

Finally, the remains 29 located at the outermost positions are removed, and here the piezoelectric vibration element unit 1 is completed (FIG. 7(III)). Since the conductive layers 22 and 23 are not present in the remains, those remains are relatively low in strength, and accordingly, may be bent and removed easily.

Figure 9:
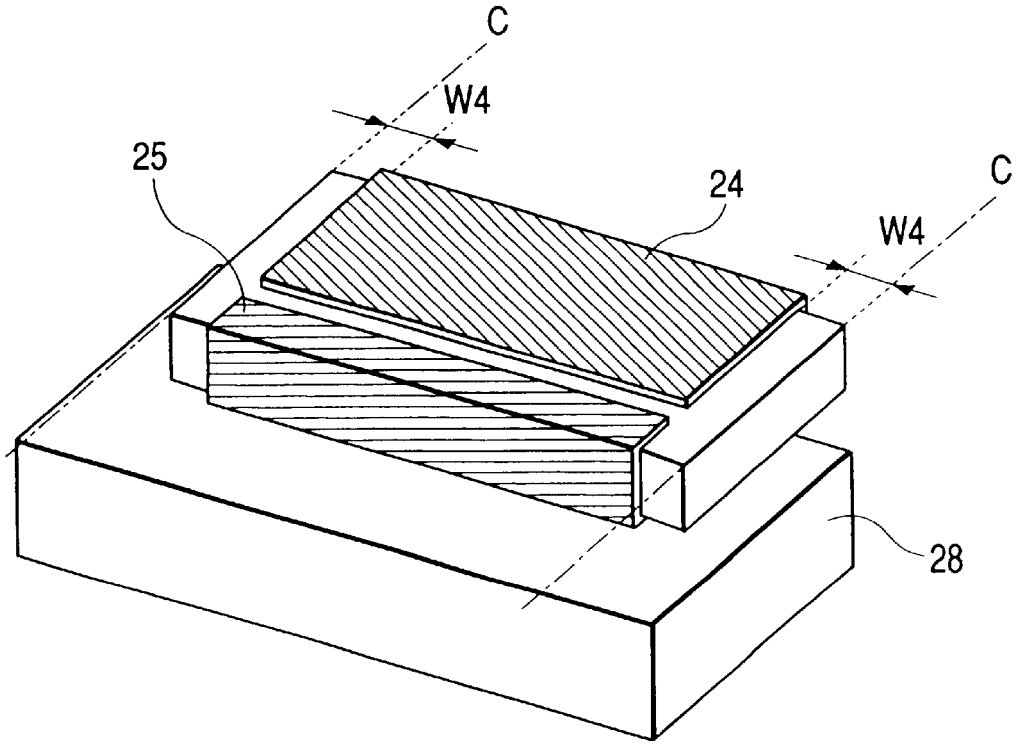
FIG. 9 is a perspective view showing another embodiment of a piezoelectric vibrating plate according to the present invention.

In the above-mentioned manufacturing method, the electrodes 24 and 25 for the external connections are formed extending over the full width of the piezoelectric vibrating plate 27. As shown in FIG. 9, in a case where those electrodes 24 and 25 are formed to reach areas where dummy piezoelectric elements are to be formed but not to reach the outermost cutting lines C (i.e. each of those electrodes 24 and 25 are distanced laterally from the respective cutting lines C by width W4), the adverse effect by the hardness of the electrodes 24 and 25 is eliminated in the cutting process of the piezoelectric vibrating plate 27, so that a more smooth cutting operation is ensured. In the illustrated example in FIG. 9, the remains 29 (7') have been completely removed.

In the embodiment mentioned above, the piezoelectric vibrating plate 27 has such a size as to allow one piezoelectric vibration element unit to be formed. In case where a plurality of piezoelectric vibration element units are formed from a large piezoelectric vibrating plate, the region not including the internal electrodes may be located in each boundary region at which one of the piezoelectric vibration units is separated from another adjacent one of the piezoelectric vibration units.

Figure 10A:
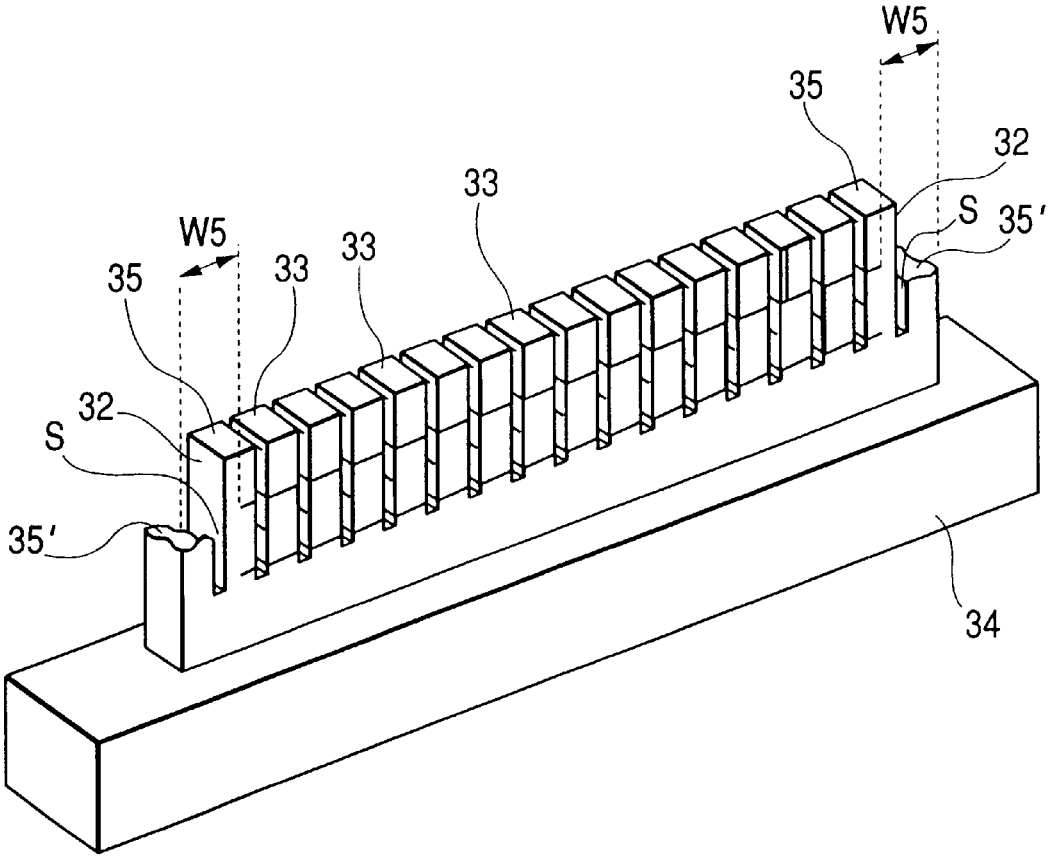
FIGS. 10A and 10B perspectively and sectionally show a piezoelectric vibration element unit and a driving piezoelectric vibration element in an inkjet recording head which is another embodiment of the invention.
Figure 10B:
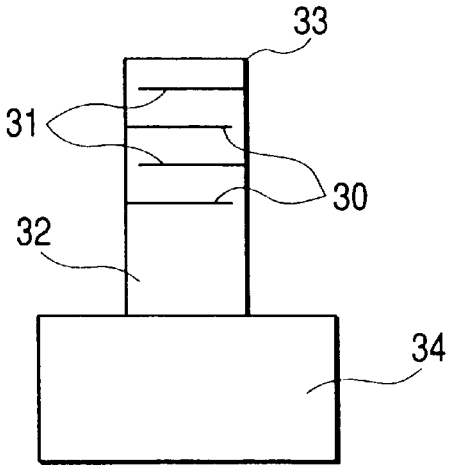

FIG. 10 shows another embodiment of a piezoelectric vibration element unit of the piezoelectric constant d33 which is formed with piezoelectric vibration elements 33 each including internal electrodes 30 and 31 layered in the longitudinal direction of the piezoelectric vibration element 33. The internal electrodes 30 and 31 with different poles are arranged such that those electrodes overlap with each other in the vibrating region with the piezoelectric material 32 being interposed therebetween (FIG. 10B), and that the internal electrodes 30 is exposed on the side face of the top and bottom portions of the piezoelectric element 33, whereas the internal electrodes 31 is exposed on the opposite side face of the top and bottom portions thereof. Those piezoelectric vibration elements 33 are fixed onto a fixing plate 34 while being arrayed at fixed pitches along the fixing plate 34. Dummy piezoelectric elements 35 are located at both the ends of the array of the piezoelectric vibration elements 33, respectively. The remains 35' of the dummy piezoelectric elements 35 are present outside the dummy piezoelectric elements 35.

Also in this embodiment, as shown in FIG. 10A, the electrodes are not present but only piezoelectric material 32 is present in the outside surfaces of the dummy piezoelectric elements 35. That is, the piezoelectric vibrating plate to be cut into a teeth or comb shape does not have electrodes in regions, each extending by an amount of a width W5 inwardly from the corresponding outer surface of the plate. The slit S to be formed for the purpose of cutting out the dummy piezoelectric element 35 from the plate is located within the region.

In the above-mentioned embodiments, the internal electrodes are not formed in the remains 7', 35' of the dummy piezoelectric elements 7, 35. In an embodiment shown in FIG. 11, internal electrodes 3' and 4' are not present only in a region D of the dummy piezoelectric element 7 which is bent and cut to form the remain 7'. In this embodiment, a part of the dummy piezoelectric element 7 to be removed as a consequence of bending and cutting the element 7, i.e. a part of the dummy piezoelectric element 7 above the region D, is reinforced by an internal electrode 4'. Therefore, the dummy piezoelectric element 7 can be bent and cut exactly at an intended position to form the remain 7'. Further, a thickness of the piezoelectric vibrating plate can be uniform over its entire area, so that distortion and warp of the piezoelectric vibrating plate are minimized when it is sintered.

Figure 11:
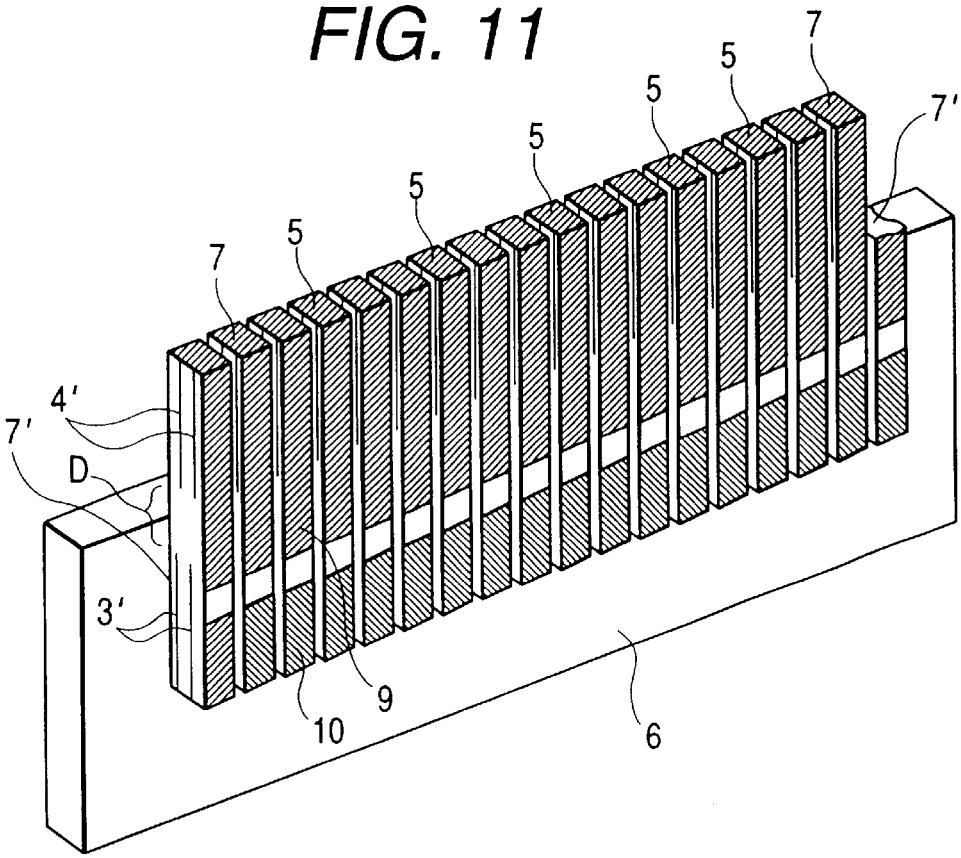
FIG. 11 is a perspective view showing another embodiment of a piezoelectric vibration element unit of the present invention.

To provide the structure as shown in FIG. 11, the steps explained with reference to FIGS. 5(II), 6(I) and 6(III) are modified preferably in the following manner: In each of the steps shown in FIGS. 5(I) and 6(III), the conductive layer 22 formed on the green sheet 21 to extend across the cutting line C for defining the positioning reference surface and to have a laterally protruded conductive layer part 22'. The laterally protruded conductive layer part 22' corresponds to the internal electrode 3'. In the step shown in FIG. 6(I), the conductive layer 23 is formed on the green sheet 21 to extend across the cutting line C for defining the positioning reference surface and to have a laterally protruded conductive layer part 23'. The laterally protruded conductive layer part 23' corresponds to the internal electrode 4'.

Figure 17:
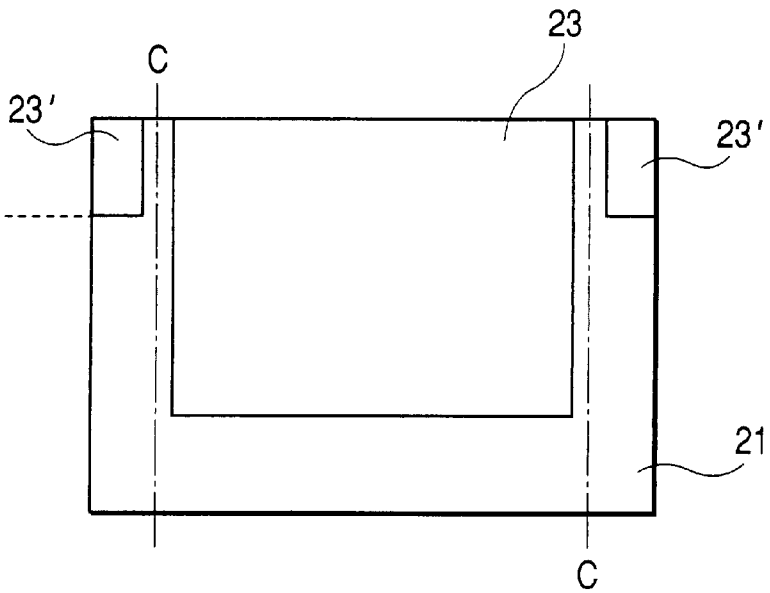
FIGS. 16 and 17 are plane views showing modified steps of a process of manufacturing a piezoelectric vibration element unit of the present invention.
Figure 16:
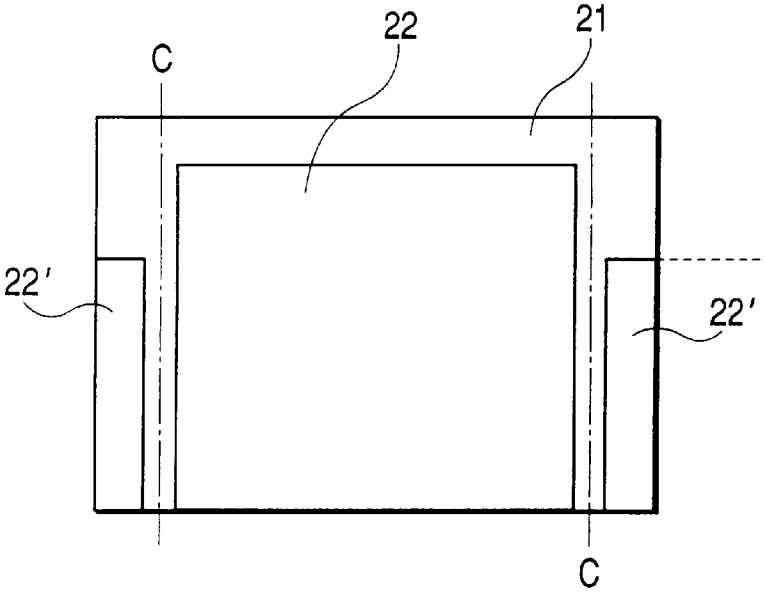
Figure 19:
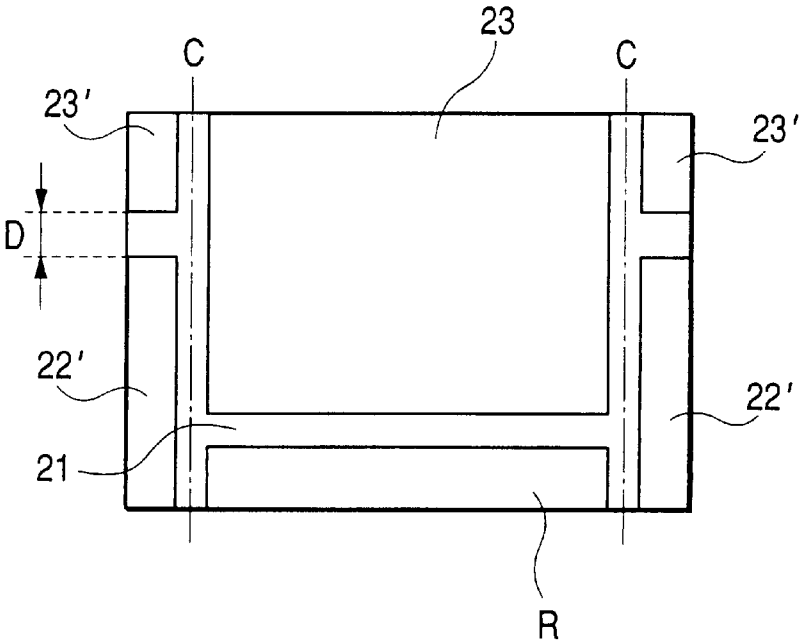
FIGS. 18 and 19 are plane views showing modified steps of a process of manufacturing a piezoelectric vibration element unit of the present invention.
Figure 18:
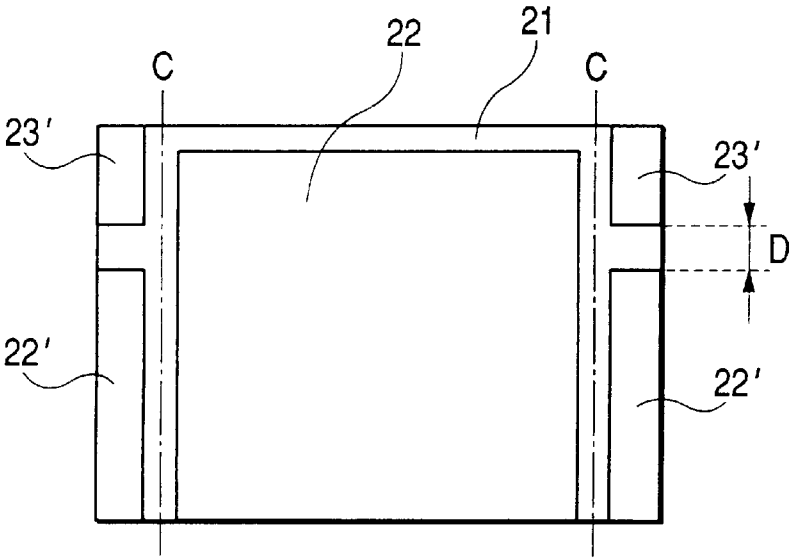
Figure 21:
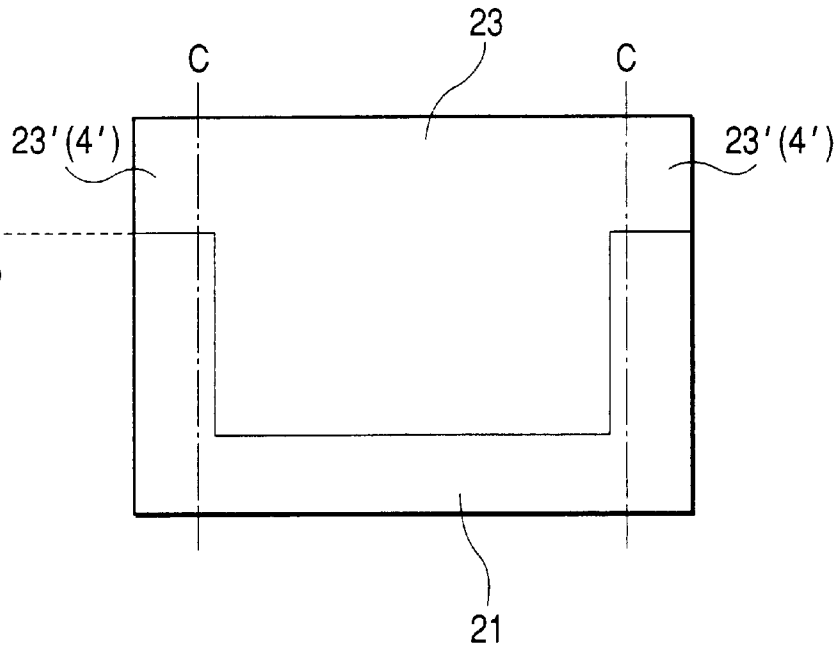
FIGS. 20 and 21 are plane views showing modified steps of a process of manufacturing a piezoelectric vibration element unit of the present invention.
Figure 20:
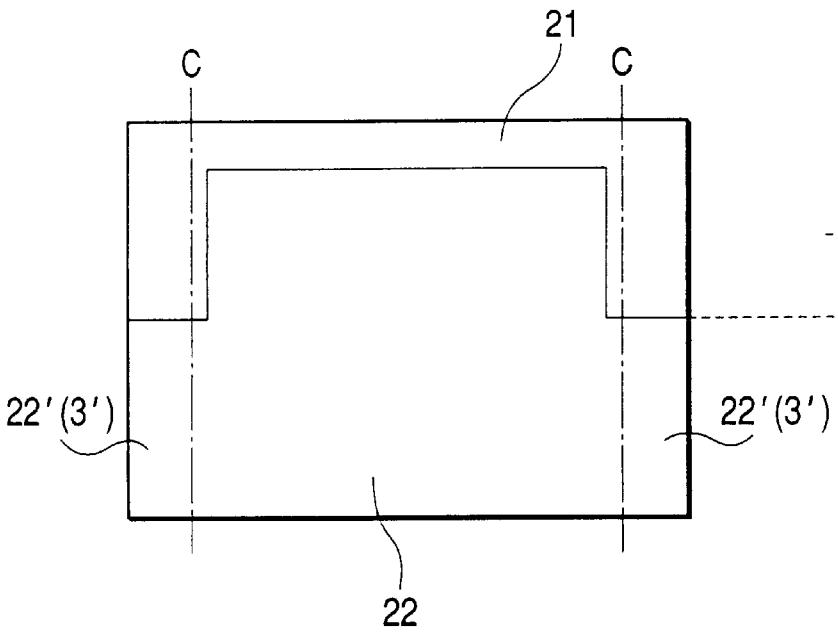

In the embodiment shown in FIG. 11, the internal electrodes 3 and 4 appear on the outer side surface (i.e. the positioning reference surface) of the positioning dummy piezoelectric element 7. Of course, the embodiment shown in FIG. 11 may be modified so that no electrode appear on the outer side surface of the positioning dummy piezoelectric element 7 as shown in FIG. 4. To provide such a structure that the dummy piezoelectric element 7 to be bent and cut to form the remain '7 has the internal electrodes 3' and 4' while the internal electrodes 3, 4, 3' and 4' do not appear on the outer side surface of the piezoelectric element 7 used as the positioning member, the steps explained with reference to FIGS. 5(II), 6(I) and 6(III) are modified preferably such that: In each of the steps shown in FIGS. 5(I) and 6(III), additional conductive layers 22' are formed on the green sheet 21 adjacent to the conductive layer 22 to form the internal electrodes 3' as shown in FIG. 16, and in the step shown in FIG. 6(I), the additional conductive layers 23' are formed on the green sheet 21 adjacent to the conductive layer 23 to form the internal electrodes 4' as shown in FIG. 17. As shown in FIGS. 16 and 17, the cutting line C for defining the positioning reference surface is located between the additional conductive layer 22' and the conductive layer 22 and between the additional conductive layer 23' and the conductive layer 23. The steps explained with reference to FIGS. 5(II), 6(I) and 6(III) may be modified such that: In each of the steps shown in FIGS. 5(I) and 6(III), additional conductive layers 22' for forming the internal electrodes 3' located below the region D and additional conductive layers 23' for forming the internal electrodes 4' located above the region D are formed on the green sheet 21 adjacent to the conductive layer 22 as shown in FIG. 18, and in the step shown in FIG. 6(I), the additional conductive layers 22' for forming the internal electrodes 3' located below the region D and the additional conductive layers 23' for forming the internal electrodes 4' located above the region D are formed on the green sheet 21 adjacent to the conductive layer 23 as shown in FIG. 19. In FIG. 19, reference numeral R designates another conductive layer formed on the green sheet 21 to make the piezoelectric vibration plate uniform in thickness and reinforce the piezoelectric vibration plate. In addition, the conductive layers 22, 23, 22', 23' and R are the same in thickness.

Figure 12:
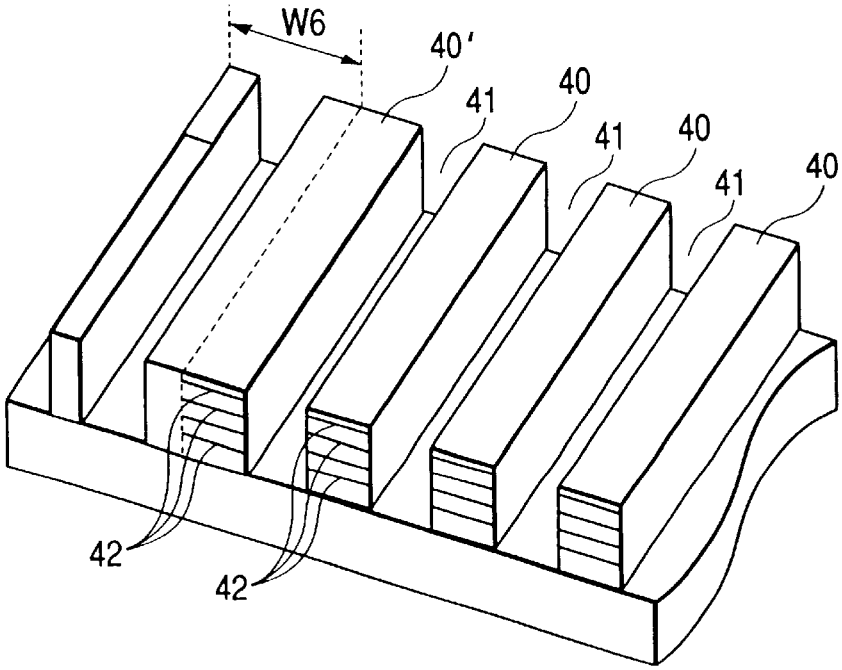
FIG. 12 is a perspective view showing an application of the invention to a recording head in which pressure generating chambers are formed by use of piezoelectric vibration elements.

In the embodiments mentioned above, the inkjet recording head is of the type in which the fluid channel unit containing ink confined therein is expanded and contracted externally. The present invention may likewise be applied to the inkjet recording head of the zale type in which spaces 41 each between adjacent piezoelectric vibration elements 40 are used as pressure generating chambers as shown in FIG. 12.

In this case, a region of the width W6, which consists of only piezoelectric material 43 and which does not include the internal electrodes 42, is formed, and a cutting line C is set in the region of the width W6 to form the outermost piezoelectric vibration element 40'. Similarly to the aforementioned embodiments, the outer surface of the outermost piezoelectric vibration element 40' does not have the internal electrodes 42 so that a width of the entire piezoelectric vibrating plate can be secured accurately.

Figure 13:
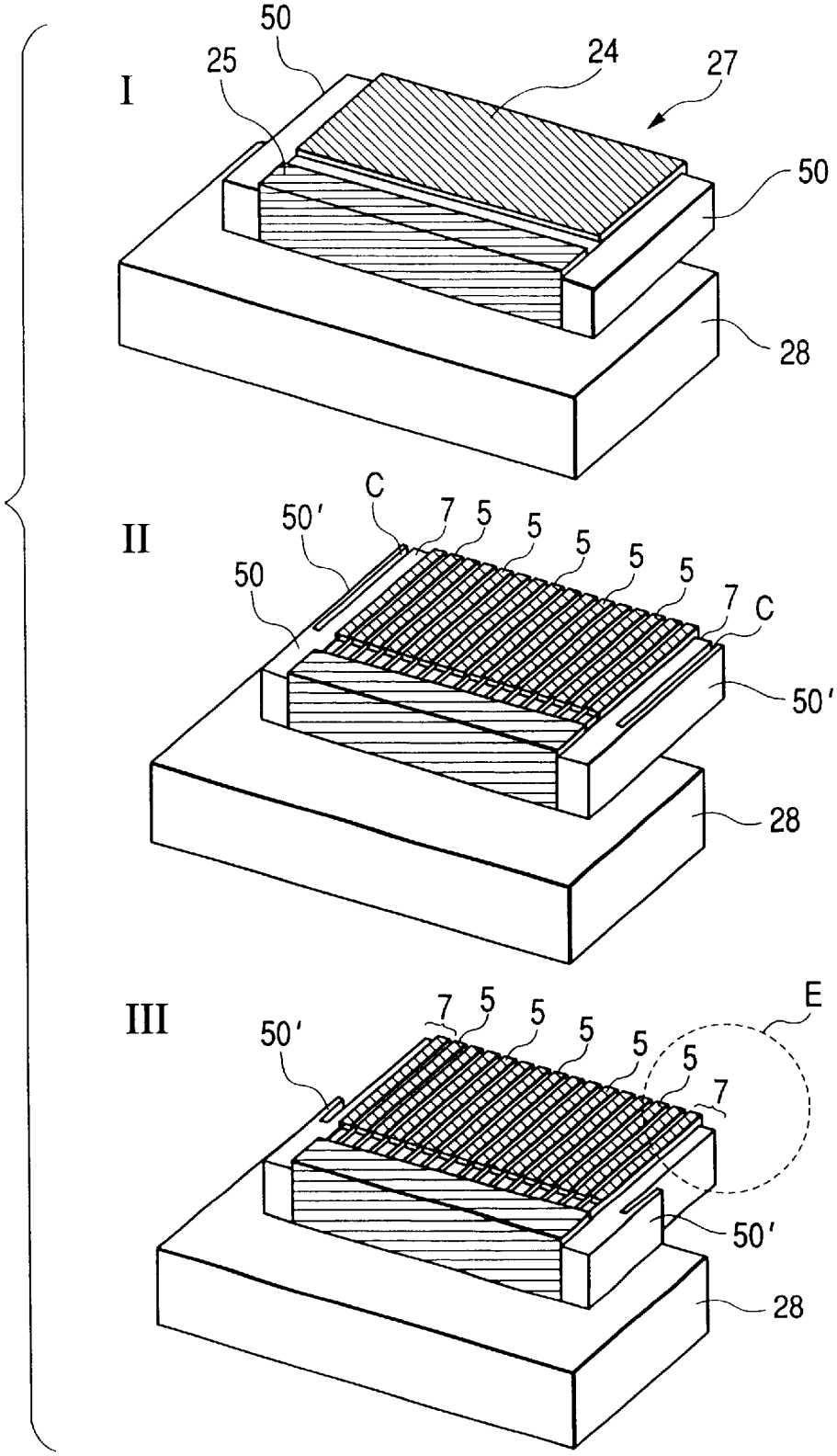

FIG. 13 is a set of perspective views showing another method of manufacturing a piezoelectric vibration element unit according to the present invention. In this embodiment, dummy piezoelectric elements 7 are each formed by a combination of a piezoelectric vibrating plate and a second member.

Figure 14:
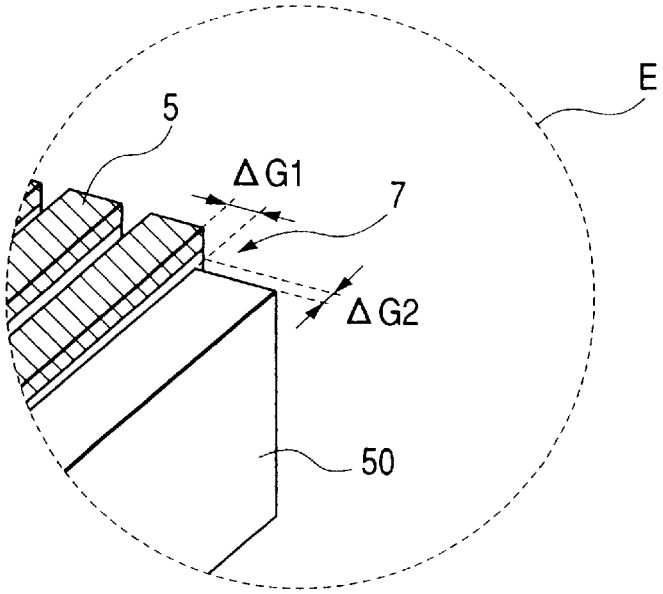
FIG. 14 is an enlarged, perspective view showing a portion E in FIG. 13.
Figure 15:
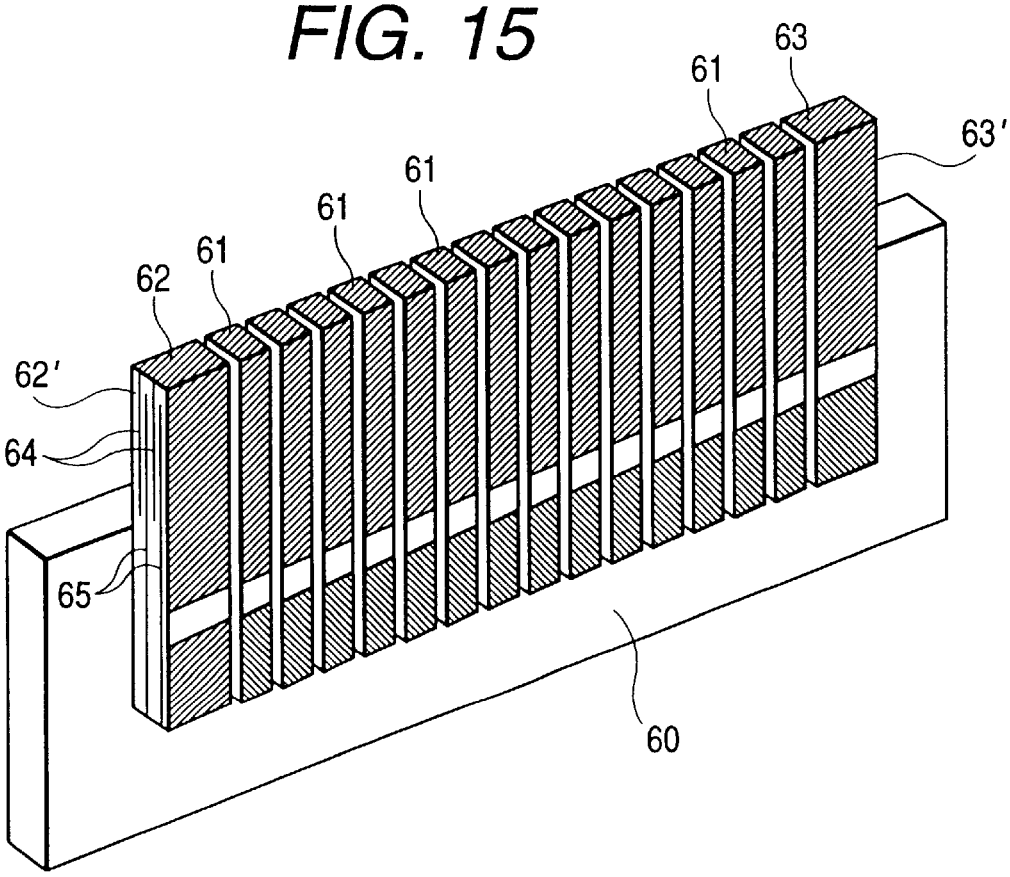
FIG. 15 is a perspective view showing a piezoelectric vibration element unit used in a related inkjet recording head.

Blocks 50, made of ceramic, e.g., alumina, or metal, e.g., stainless steel, are bonded to both side end surfaces of a piezoelectric vibrating plate 27, by adhesive layers being interlayered therebetween. In this case, external electrodes 24 and 25 serving as electrodes used for connecting to a flexible cable 8 have been formed on the surfaces of the piezoelectric vibrating plate 27. As shown in FIG. 14, each block 50 is slightly thinner in thickness than the piezoelectric vibrating plate 27 by $\Delta G1$, and the distal end of each block 50 is slightly recessed toward a fixing plate 28 from the distal end of the piezoelectric vibration plate 27 by $\Delta G2$. The surfaces of the blocks 50, which face the fixing plate 28, are also secured thereto by use of adhesive layers (FIG. 13(I)).

In a case where the blocks 50 are made of conductive material, it is preferable that the internal electrodes are not exposed in the side end surfaces of the piezoelectric vibrating plate 27, as in the previously mentioned embodiments.

A dielectric polarization process is carried out in a manner that in this state, polarizing voltage applying electrodes having areas large enough to cover at least the piezoelectric vibrating plate 27 are brought into contact with the connection electrodes 24 and 25. It is noted here that the polarizing voltage applying electrodes reliably contact the piezoelectric vibrating plate 27 since the blocks 50 are each thinner than the piezoelectric vibrating plate 27.

After the polarizing process ends, the piezoelectric vibrating plate is cut into a teeth or comb shape with a cutting tool, e.g., a wire saw, such that both outermost cut lines C are set at the respective blocks 50, and the width of the dummy piezoelectric elements 7 and the width of the piezoelectric vibration elements 5 are exactly secured (FIG. 13(II)). The piezoelectric vibrating plate can be cut smoothly to have cut surfaces exactly along the intended cutting lines C since the blocks 50 are made of homogeneous material.

After the remains 50' of the blocks 50, which are located at the outermost ends of the array of the piezoelectric vibration elements, are removed, a piezoelectric vibration element unit is completed (FIG. 13(III)). Those remains can be removed relatively easily since those are made of homogeneous material.

The distal ends of the dummy piezoelectric elements 7 of the piezoelectric vibration element unit thus manufactured are regulated in position with respect to the distal end of the piezoelectric vibrating plate 27 formed highly accurately. Therefore, the dummy piezoelectric elements 7 can be used to position the piezoelectric vibration plate 27 to the fluid channel unit with high accuracy. Further, the dummy piezoelectric elements 7 are reinforced by the blocks 50 having a higher toughness than the piezoelectric material. Therefore, even if the piezoelectric vibration element unit is inserted into a head holder by using the outside surfaces of the blocks 50 as a reference, the piezoelectric element unit can withstand external forces applied during its assembling, whereby it will not be damaged.

While the blocks are provided on the piezoelectric vibrating plate of the piezoelectric constant d31 in the above-mentioned embodiment, it may likewise be applied to the formation of the dummy piezoelectric elements when a piezoelectric vibrating plate of the piezoelectric constant d33 is cut into piezoelectric vibration elements. That is, the blocks may be attached to the piezoelectric vibration plate after the piezoelectric vibration plate is subjected to the polarizing process and before the piezoelectric vibration plate is cut into piezoelectric vibration elements.

As shown in FIG. 4, a proximal end 7*p* of the dummy piezoelectric element 7 may be separated from a proximal end 5*p* of an adjacent piezoelectric element 5 and fixed with respect to the proximal end 5*p* of the adjacent piezoelectric element 5 through the fixing plate 6. Alternatively, as shown in FIG. 3, the proximal end 7*p* of the positioning dummy piezoelectric element 7 may be integral with the proximal end 5*p* of the adjacent active piezoelectric element 5 as long as the segment electrodes 4 in the positioning dummy piezoelectric element 7 is electrically insulated from the segment electrodes 4 in the adjacent active piezoelectric element 5. Similarly, the proximal ends 5*p* of the adjacent piezoelectric elements 5 may be separated one from the other, or integral together.

Figure 22:
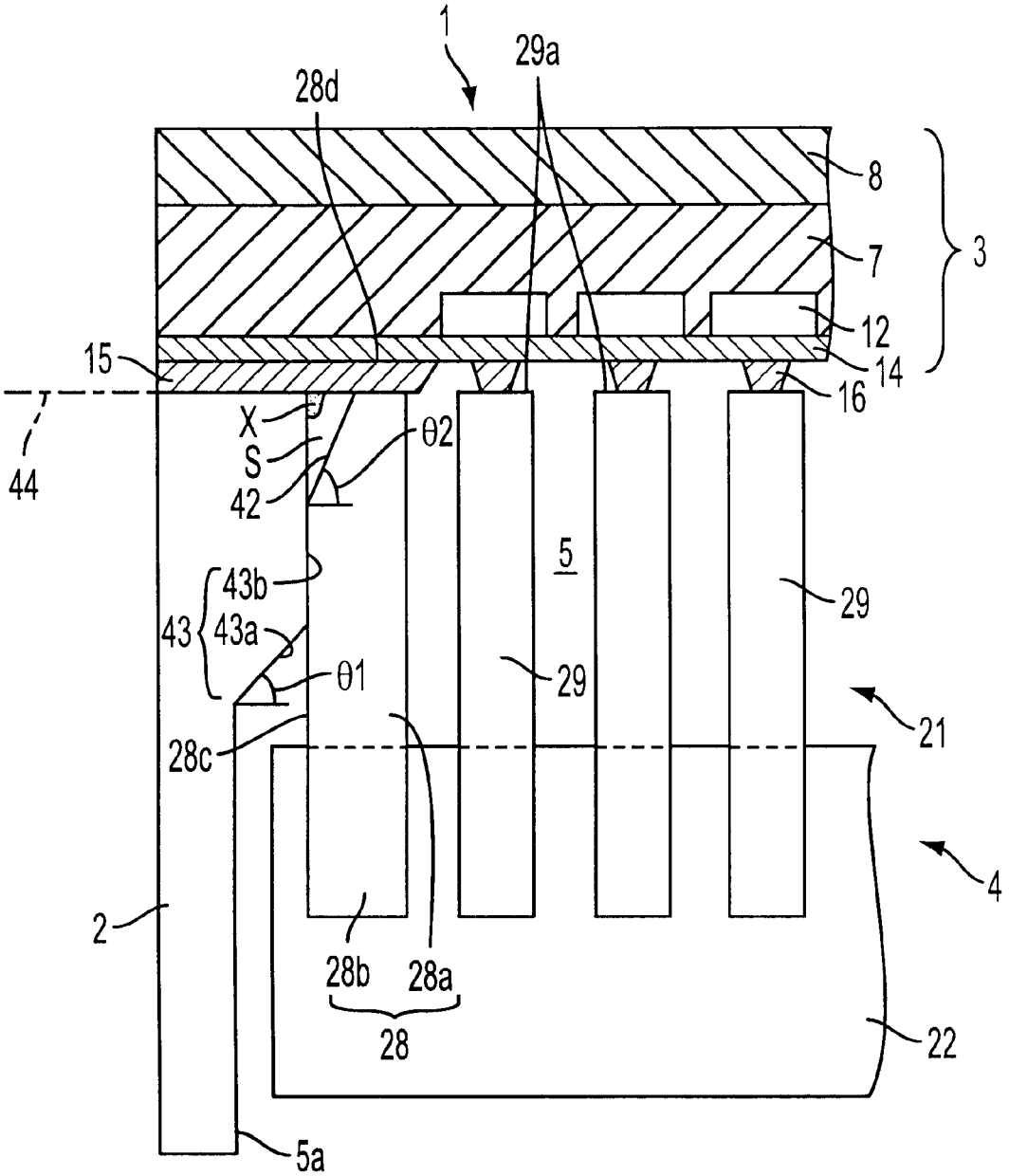
FIG. 22 shows an additional embodiment of the present invention.

FIG. 22 shows an additional embodiment of the present invention. Each of dummy vibration elements 28 and 28 (a left end dummy element 28 is shown in FIG. 22) is provided at its leading end with a chamfered portion 42. The chamfered portion 42 is formed in such a manner that an outer corner portion of the dummy vibration element 28 in an array direction of vibration elements is removed by chamfering or the like. The chamfered portion 42 is not limited to have an illustrated shape. For example, the chamfered portion 42 may be have an L-shape, an arcuate shape, etc.

The chamfered portion 42 defines a space (relief space) S into which an adhesive agent, a burr or the like can escape. When a piezoelectric vibration unit 4 is assembled into a case 2 to which a fluid channel forming unit 3 has been attached, the dummy vibration element 28 is guided by a slope guide portion 43 so that the outer surface 28*c* contacts the surface 43*b* and the leading end surface 28*d* contacts a stainless steel plate 15 of the flow passage forming unit 3. In this contact condition, the chamfered portion 42 defines the relief space S that is located at the outermost end in the array direction and adjacent the leading end of the dummy vibration element 28.

A superfluous adhesive agent X, which has flowed out from a mating interface between the case 2 and the flow channel forming unit 3, can be accommodated within the relief space S. In short, the relief space S can be used as a buffer region for accommodating the adhesive agent X therein.

This can positively eliminate a problem caused due to the presence of the solidified adhesive agent X between the leading end surface 28*d* and the stainless steel plate 15, such as an offset of the mounting position of the piezoelectric vibration unit 4 rearwardly from a correct position, and a consequent adhesion error occurring between a leading end surface 29*a* of an active vibration element 29, and an associated island portion 16. Since the piezoelectric vibration unit 4 can be mounted at the correct position, the leading end surfaces 29*a* of the active vibration elements 29 can be surely adhered to the respective island portions 16.

An inclined angle θ2 of the chamfered portion 42 can be set to be any arbitrary angle as long as the relief space S of a necessary volume and a rigidity required for the dummy vibration element 28 can be secured. For example, the inclined angle is preferably 5 to 45 degrees, and more preferably 10 to 20 degrees.

Even if a parting line 44 during molding of the case 2 is located substantially on the fixing surface of the case 2 to the flow channel forming unit 3 and a burr is consequently formed on a peripheral portion of the opening of an accommodating space 5, the burr can be accommodated within the relief space S similarly, and thus prevented from biting between dummy vibration element 28 and the stainless steel plate 15. That is, the dummy vibration element 28 can be securely contacted with the stainless steel plate 15. Accordingly, piezoelectric vibration unit 4 can be fixed at the correct position, and the active vibration elements 29 can be surely adhered without error.

Next, the slope guide portion 43 will be described. The slope guide portion 43 is formed on the inner wall 5*a* (a shorter side inner wall of the accommodating space 5) to be protruded toward the opposite inner wall (the other shorter side inner wall of the accommodating space 5). The similar slope guide portion 43 is also formed on the opposite inner wall. The slope guide portion 43 has a slope guide surface 43*a* and a contact surface 43*b*. The contact surface 43*b* is the surface to be contacted with the outer surface 28*c* of the dummy vibration element 28 inserted into the accommodating space 5. The slope guide surface 43*a* serves to guide the leading end of the dummy vibration element 28 to the contact surface 43*b*, and is configured to be closer to the opposite inner wall as it approaches the leading end side of the case 2.

To accommodate the piezoelectric vibration unit 4 within the accommodating space 5, the unit 4 is inserted through a back side opening of the accommodating space 5 in a state that leading ends of vibration element group 21 is directed forward and that the outer surface 28*c* of the dummy vibration element 28 is offset to the inner wall 5*a*.

It is preferable to set an inclined angle θ1 of the slope guide surface 43*a* to be equal to or smaller than the inclined angle θ2 of the chamfered portion 42. This angular relationship between the inclined angle θ1 and the inclined angle θ2 causes a surface contact between the chamfered portion 42 of the dummy vibration element 28 and the slope guide surface 43*a*, or a contact between an apex formed by the chamfered portion 42 and the leading end surface 28*d* and the slope guide surface 43*a* during this insertion, and accordingly, a collision against the dummy vibration element 28 in association with this insertion can be suppressed.

The piezoelectric vibration unit 4 is further inserted toward the flow channel forming unit 3 from this contact state, the apex formed by the chamfered portion 42 and the leading end surface 28*d* is moved along the slope guide surface 43*a*, thereby smoothly inserting the piezoelectric vibration unit 4 into the accommodating space 5.

By cutting out the outer corner portion of the leading end of the dummy piezoelectric element 28 to provide the chamfered portion 42 and providing the slope guide portion 43 for guiding the dummy vibration element 28, the insertion ability of the piezoelectric vibration unit 4 into the accommodating space 5 of the case 2 can be improved, thereby effectively eliminating the damage caused on the dummy piezoelectric element 28.

FIG. 22 shows an additional embodiment of the present invention.

Although the embodiments of the present invention have been described with reference to a case that the present invention is applied to an arrangement of an inkjet recording head, the present invention should not be restricted thereto or thereby. For example, the present invention is applicable to various actuators, such as liquid ejection devices, that employ a piezoelectric vibration element or piezoelectric vibration elements.

What is claimed is:

1. An inkjet recording head comprising:

pressure generating chambers; and a piezoelectric vibration element unit including:

a substrate; and a plurality of axially expandable piezoelectric vibration elements arranged on the substrate to form an array, each of the piezoelectric vibration elements being formed of piezoelectric material and internal electrodes that are alternately layered, each of the piezoelectric vibration elements increasing and decreasing volume of an associated one of the pressure generating chambers, wherein a dummy piezoelectric vibration element is provided at least one end of the array of the piezoelectric vibration elements, and a region not including the internal electrodes is provided in the vicinity of a side surface of the dummy piezoelectric vibration element.

2. An inkjet recording head in accordance with claim 1, wherein the side surface of the dummy piezoelectric vibration element is formed of only the piezoelectric material.

3. An inkjet recording head in accordance with claim 1, wherein each of said piezoelectric vibration elements has a piezoelectric constant d31 and is arranged so that the internal electrodes extend parallel to an axial direction, the internal electrodes of a first set are exposed only on a first axial end face of the piezoelectric vibration element, the internal electrodes of a second set different in polarity from the first set are exposed only on a second, opposite axial end face thereof, and the internal electrodes of the first and second sets overlap in a vibrating region of the piezoelectric vibration element with the piezoelectric material interposed therebetween.

4. An inkjet recording head in accordance with claim 1, wherein each of said piezoelectric vibration elements has a piezoelectric constant d33 and is arranged so that the internal electrodes extend perpendicular to an axial direction, the internal electrodes of a first set are exposed only on a first side face of the piezoelectric vibration element, the internal electrodes of a second set different in polarity from the first set are exposed only on a second, opposite side face thereof, and the internal electrodes of the first and second sets overlap in a vibrating region of the piezoelectric vibration element with the piezoelectric material interposed therebetween.

5. An inkjet recording head in accordance with claim 1, wherein a remaining piece is present outside the dummy piezoelectric element.

6. An inkjet recording head in accordance with claim 1, wherein external electrodes are formed which connect the internal electrodes to signal supplying means.

7. An inkjet recording head in accordance with claim 6, wherein the external electrodes formed on the dummy piezoelectric element is narrower in width than said dummy piezoelectric element.

8. An inkjet recording head in accordance with claim 1, wherein by using the dummy piezoelectric element as a positioning reference, the piezoelectric vibration element unit is brought into contact with a fluid channel forming unit through a head unit, the fluid channel forming unit being formed by laminating a fluid channel forming substrate defining a reservoir, ink supplying ports and pressure generating chambers, an elastic plate which is brought into contact with a distal end of each piezoelectric vibration element to increase and reduce the volumes of said pressure generating chambers, and a nozzle plate which closes a surface of said fluid channel forming substrate and has nozzle orifices for ejecting ink droplets.

9. An inkjet recording head in accordance with claim 1, wherein the side surface of the dummy piezoelectric element functions as a positioning reference between the piezoelectric element unit and a head holder.

10. An inkjet recording head in accordance with claim 1, wherein a block is disposed on the outer side surface of the dummy piezoelectric element.

11. An inkjet recording head in accordance with claim 10, wherein a thickness of the block is thinner than a thickness of the piezoelectric vibration element, and a distal end of the block is recessed toward a fixing plate from a distal end of the piezoelectric vibration element.

12. An inkjet recording head in accordance with claim 10, wherein the block is made of a material having a higher toughness than that of the piezoelectric material.

13. An inkjet recording head in accordance with claim 10, wherein the block is made of ceramic or metal.

14. An inkjet recording head in accordance with claim 10, wherein a remaining piece is present outside the dummy piezoelectric element.

15. An ink jet recording head according to claim 1, wherein a corner portion of the dummy piezoelectric vibration element, which is located at a leading end of the dummy piezoelectric vibration element and at an outer side of the array of the piezoelectric vibration elements, is removed.

16. An ink jet recording head according to claim 15, wherein the dummy piezoelectric vibration element is a positioning element for positioning the array of the piezoelectric vibration elements.

17. An ink jet recording head according to claim 1, wherein the dummy piezoelectric vibration element has a chamfered portion which is located at a leading end of the dummy piezoelectric vibration element and at an outer side of the array of the piezoelectric vibration elements.

18. A piezoelectric vibration element unit, wherein a dummy piezoelectric vibration element is provided at least one end of the array of piezoelectric vibration elements, and a region not including internal electrodes is provided in the vicinity of an outer side surface of the dummy piezoelectric vibration element.

19. A piezoelectric vibration unit in accordance with claim 18, wherein the outer side surface of the dummy piezoelectric vibration element is formed of only piezoelectric material.

20. A piezoelectric vibration unit in accordance with claim 18, wherein each of the piezoelectric vibration elements has a piezoelectric constant d31 and is arranged so that the internal electrodes extend parallel to an axial direction, the internal electrodes of a first set are exposed only on a first axial end face of the piezoelectric vibration element, the internal electrodes of a second set different in polarity from the first set are exposed only on a second, opposite axial end face thereof, and the internal electrodes of the first and second sets overlap in a vibrating region of the piezoelectric vibration element with the piezoelectric material interposed therebetween.

21. A piezoelectric vibration unit in accordance with claim 18, wherein each of said piezoelectric vibration elements has a piezoelectric constant d33 and is arranged so that the internal electrodes extend perpendicular to an axial direction, the internal electrodes of a first set are exposed only on a first side face of the piezoelectric vibration element, the internal electrodes of a second set different in polarity from the first set are exposed only on a second, opposite side face thereof, and the internal electrodes of the first and second sets overlap in a vibrating region of the piezoelectric vibration element with the piezoelectric material interposed therebetween.

22. A piezoelectric vibration unit in accordance with claim 18, wherein a remaining piece is present outside the dummy piezoelectric element.

23. A piezoelectric vibration unit in accordance with claim 18, wherein external electrodes are formed which connect the internal electrodes to signal supplying means.

24. A piezoelectric vibration unit in accordance with claim 23, wherein the external electrodes formed on the dummy piezoelectric element is narrower in width than said dummy piezoelectric element.

25. A piezoelectric vibration unit in accordance with claim 18, wherein a block is disposed on the outer side surface of the dummy piezoelectric element.

26. A piezoelectric vibration unit in accordance with claim 25, wherein a thickness of the block is thinner than a thickness of the piezoelectric vibration element, and a distal end of the block is recessed toward a fixing plate from a distal end of the piezoelectric vibration element.

27. A piezoelectric vibration unit in accordance with claim 25, wherein the block is made of a material having a higher toughness than that of the piezoelectric material.

28. A piezoelectric vibration unit in accordance with claim 25, wherein the block is made of ceramic or metal.

29. A piezoelectric vibration unit in accordance with claim 25, wherein a remaining piece is present outside the dummy piezoelectric element.

30. A piezoelectric vibration element unit according to claim 18, wherein a corner portion of the dummy piezoelectric vibration element, which is located at a leading end of the dummy piezoelectric vibration element and at an outer side of the array of the piezoelectric vibration elements, is removed.

31. A piezoelectric vibration element unit according to claim 30, wherein the dummy piezoelectric vibration element is a positioning element for positioning the array of the piezoelectric vibration elements.

32. A piezoelectric vibration element unit according to claim 18, wherein the dummy piezoelectric vibration element has a chamfered portion which is located at a leading end of the dummy piezoelectric vibration element and at an outer side of the array of the piezoelectric vibration elements.

33. An actuator, comprising:

a fixing plate;

a plurality of piezoelectric vibrators fixed to the fixing plate in a row;

a positioning member disposed at, at least one of opposite ends of the row of vibrators outside of the outermost one of the vibrators in a direction in which the vibrators are arranged in the row, the positioning member being fixed to the fixing plate, wherein the positioning member has a reference surface defined by homogenous material, and a holder with which the reference surface of the positioning member is contacted to position the piezoelectric vibrators with respect to the holder.

34. An actuator according to claim 33, wherein the positioning member is disposed on each of opposite ends of the row of vibrators outside the outermost ones of the vibrator in the direction.

35. An actuator according to claim 33, wherein a proximal end of the positioning member is integral with a proximal end of the outermost one of the vibrators.

36. An actuator according to claim 33, wherein a proximal end of the positioning member is separated from a proximal end of the outermost one of the vibrators, but fixed with respect to the proximal end of the outermost one of the vibrators through the fixing plate.

37. An actuator according to claim 33, wherein the homogeneous material includes one of piezoelectric material, ceramic, and metal.

38. An actuator according to claim 33, wherein the reference surface is disposed to have a predetermined positional relationship to distal ends of the vibrators.

39. An actuator according to claim 33, wherein the positioning member has a piezoelectric inactive region extending over the entire length of the positioning member.

40. An actuator according to claim 33, wherein the reference surface is continuous with and perpendicular to a distal end face of the positioning member.

41. An actuator, comprising:

a fixing plate;

a plurality of piezoelectric vibrators fixed to the fixing plate in a row; and a positioning member disposed at, at least one of opposite ends of the row of vibrators outside of the outermost one of the vibrators in a direction in which the vibrators are arranged in the row, the positioning member being fixed to the fixing plate, wherein the positioning member has a reference surface defined by homogenous material, wherein the homogeneous material is lower in hardness than internal electrodes embedded in the piezoelectric vibrators.

42. An actuator, comprising:

a fixing plate;

a plurality of piezoelectric vibrators fixed to the fixing plate in a row; and a positioning member disposed at, at least one of opposite ends of the row of vibrators outside of the outermost one of the vibrators in a direction in which the vibrators are arranged in the row, the positioning member being fixed to the fixing plate, wherein the positioning member has a reference surface defined by homogenous material, wherein internal electrodes are embedded in the positioning member so as not to be exposed on the reference surface.

* * * * *